US006854534B2

(12) United States Patent
Livingstone

(10) Patent No.: US 6,854,534 B2
(45) Date of Patent: Feb. 15, 2005

(54) TWO STRING DRILLING SYSTEM USING COIL TUBING

(76) Inventor: James I. Livingstone, 8 Lake Placid Bay S.E., Calgary, Alberta (CA), T2P 5A6

( * ) Notice: Subject to any disclaimer, the term of this patent is extended or adjusted under 35 U.S.C. 154(b) by 0 days.

(21) Appl. No.: 10/347,861

(22) Filed: Jan. 22, 2003

(65) Prior Publication Data

US 2003/0155156 A1 Aug. 21, 2003

Related U.S. Application Data

(60) Provisional application No. 60/349,341, filed on Jan. 22, 2002.

(51) Int. Cl.[7] ..... E21B 7/00

(52) U.S. Cl. ..... 175/57; 175/213; 175/215; 175/320

(58) Field of Search ..... 175/57, 213, 215, 175/320, 324; 166/242.2, 384, 385

(56) References Cited

U.S. PATENT DOCUMENTS

| | | | |
|---|---|---|---|
| 2,609,386 | A | 9/1952 | Knox |
| 3,075,589 | A | 1/1963 | Grable et al. |
| 3,770,006 | A | 11/1973 | Sexton et al. |
| 3,792,429 | A | 2/1974 | Patton et al. |
| 3,795,283 | A | 3/1974 | Oughton |
| 3,920,090 | A | 11/1975 | McQueen et al. |
| 4,055,224 | A | 10/1977 | Wallers |

(List continued on next page.)

FOREIGN PATENT DOCUMENTS

| | | |
|---|---|---|
| CA | 1325969 | 10/1987 |
| EP | 0787888 | 5/1997 |
| EP | 1 245 783 | 2/2002 |
| FR | 2597150 | 4/1986 |
| GB | 2366079 | 10/2000 |
| WO | WO 97/05381 | 2/1997 |
| WO | WO 97/35083 | 9/1997 |
| WO | WO 00/57019 | 9/2000 |
| WO | WO 01/90528 | 11/2001 |
| WO | WO 02/10549 | 2/2002 |

OTHER PUBLICATIONS

Underbalanced Drilling, Nowsco.

Nowsco/Downhole Systems: "Test, Treat, Test System Using a Concentric Coiled Tubing/DST Package"; Hoyer, Fried & Sask.

(List continued on next page.)

*Primary Examiner*—Hoang Dang

(57) ABSTRACT

Method and apparatus for drilling a well bore in a hydrocarbon formation using concentric coiled tubing drill string having an inner coiled tubing string and an outer coiled tubing string defining an annulus therebetween. A drilling device comprising a reciprocation air hammer and a dull bit, a positive displacement motor and a reverse circulating drill bit, or a reverse circulating mud motor and a rotary drill bit, is provided at the lower end of the concentric coiled tubing drill string. Drilling medium is delivered through the annulus or inner coiled tubing string for operating the drilling device to form a borehole. Exhaust drilling medium comprising drilling medium, drilling cuttings and hydrocarbons is removed from the well bore by extraction through the other of the annulus or inner coiled tubing string.

65 Claims, 7 Drawing Sheets

U.S. PATENT DOCUMENTS 4,100,528 A 7/1978 Bernard et al.
4,102,418 A * 7/1978 Kammerer, Jr. ..... 175/324
4,219,087 A 8/1980 Johnson
4,243,252 A 1/1981 Johnson
4,321,974 A 3/1982 Klemm
4,354,559 A * 10/1982 Johnson ..... 175/71
4,391,328 A 7/1983 Aumann
4,431,069 A 2/1984 Dickinson, III et al.
4,461,448 A 7/1984 Huey et al.
4,463,814 A 8/1984 Horstmeyer et al.
4,509,606 A 4/1985 Willis
4,534,426 A 8/1985 Hooper
4,647,002 A 3/1987 Crutchfield
4,671,359 A 6/1987 Renfro
4,681,164 A 7/1987 Stacks
4,705,119 A 11/1987 Kostylev et al.
4,709,768 A 12/1987 Kostylev et al.
4,744,420 A 5/1988 Patterson et al.
4,790,391 A 12/1988 Hamamura et al.
4,832,126 A 5/1989 Roche
5,006,046 A 4/1991 Buckman et al.
5,020,611 A 6/1991 Morgan et al.
5,033,545 A * 7/1991 Sudol ..... 166/312
5,068,842 A 11/1991 Naito
5,086,842 A * 2/1992 Cholet ..... 166/312
5,178,223 A * 1/1993 Smet ..... 175/424
5,199,515 A * 4/1993 Sinclair et al. ..... 175/213
5,236,036 A 8/1993 Ungemach et al.
5,285,204 A 2/1994 Sas-Jaworsky
5,348,097 A 9/1994 Giannesini et al.
5,396,966 A 3/1995 Roos, Jr. et al.
5,411,105 A 5/1995 Gray
5,435,395 A 7/1995 Connell
5,497,841 A * 3/1996 Cox et al. ..... 175/71
5,513,528 A 5/1996 Holenka et al.
5,575,451 A 11/1996 Colvin et al.
5,638,904 A 6/1997 Misselbrook et al.
5,720,356 A 2/1998 Gardes
5,881,813 A 3/1999 Brannon et al.
5,890,540 A 4/1999 Pia et al.
5,892,460 A 4/1999 Jerabek et al.
6,015,015 A 1/2000 Luft et al.
6,047,784 A * 4/2000 Dorel ..... 175/61
6,065,550 A 5/2000 Gardes
6,158,531 A 12/2000 Vail, III
6,189,617 B1 2/2001 Sorhus et al.
6,192,985 B1 2/2001 Hinkel et al.
6,196,336 B1 3/2001 Fincher et al.
6,209,663 B1 4/2001 Hosie
6,209,665 B1 4/2001 Holte
6,213,201 B1 4/2001 Renkis
6,250,383 B1 6/2001 Patel
6,263,987 B1 7/2001 Vail, III
6,325,159 B1 12/2001 Peterman et al.
6,359,438 B1 3/2002 Bittar
6,377,050 B1 4/2002 Chemali et al.
6,394,197 B1 5/2002 Holte
6,405,809 B2 6/2002 Patel et al.
6,481,501 B2 11/2002 Chavez et al.
6,497,290 B1 * 12/2002 Misselbrook et al. ..... 166/384
2002/0000332 A1 1/2002 Marecka et al.
2003/0141111 A1 7/2003 Pia
2003/0150621 A1 8/2003 Pia

OTHER PUBLICATIONS

BlackMax Downhole Tools; An NQL Drilling Tools Inc. Company; Electro Magnetic Measurement While Drilling; Oil & Gas Application; EM=MWD.

Logging While Drilling; http://www.odp.tamu.edu/publications/196_IR/chap_2/02_.htm.

Drilling and Formation Evaluation; Baker Hughes; www.bakerhughes.com/bakerhughes/products/well.htm.

On Trak MWD System; Baker Hughes; www.bakerhughes.com/integ/evaluation/ontrek/index.htm.

PressTEQ Application Examples; Baker Hughes; www.bakerhughes.com/integ/D&P/pressure/index.htm.

Thruster Drilling System; Baker Hughes: www.bakerhughes.com/integ/Drilling/thruster/index.htm.

Coiled Tubing; Baker Hughes; Baker Oil Tools Coiled Tubing Solutions; www.bakerhughes.com/bol/coiled_tubing/index/htm.

COLT Coil Tubing Drilling Bottom Hole Assembly; Antech Special Engineering Products; Coiled Tubing Downhole Tools.

* cited by examiner

TWO STRING DRILLING SYSTEM USING COIL TUBING

This application claims the benefit of Provisional application Ser. No. 60/349,341, filed Jan. 22, 2002.

FIELD OF THE INVENTION

The present invention relates generally to a drilling method and apparatus for exploration and production of oil, natural gas, coal bed methane, methane hydrates, and the like. More particularly, the present invention relates to a concentric coiled tubing drill string drilling method and apparatus useful for reverse circulation drilling.

BACKGROUND OF THE INVENTION

Drilling for natural gas, oil, or coalbed methane is conducted in a number of different ways. In conventional overbalanced drilling, a weighted mud system is pumped through a length of jointed rotating pipe, or, in the case of coiled tubing, through a length of continuous coiled tubing, and positive displacement mud motor is used to drive a drill bit to drill a borehole. The drill cuttings and exhausted pumped fluids are returned up the annulus between the drill pipe or coiled tubing and the walls of the drilled formation. Damage to the formations, which can prohibit their ability to produce oil, natural gas, or coalbed methane, can occur by filtration of the weighted mud system into the formation due to the hydrostatic head of the fluid column exceeding the pressure of the formations being drilled. Damage may also occur from the continued contact of the drilled formation with drill cuttings that are returning to surface with the pumped fluid.

Underbalanced drilling systems have been developed which use a mud or fluid system that is not weighted and under pumping conditions exhibit a hydrostatic head less than the formations being drilled. This is most often accomplished by pumping a commingled stream of liquid and gas as the drilling fluid. This allows the formations to flow into the well bore while drilling, thereby reducing the damage to the formation. Nevertheless, some damage may still occur due to the continued contact between the drill cuttings and exhausted pumped fluid that are returning to surface through the annulus between the drill string or coiled tubing and the formation.

Air drilling using an air hammer or rotary drill bit can also cause formation damage when the air pressure used to operate the reciprocating air hammer or rotary drill bit exceeds formation pressure. As drill cuttings are returned to surface on the outside of the drill string using the exhausted air pressure, damage to the formation can also occur.

Formation damage is becoming a serious problem for exploration and production of unconventional petroleum resources. For example, conventional natural gas resources are deposits with relatively high formation pressures. Unconventional natural gas formations such as gas in low permeability or "tight" reservoirs, coal bed methane, and shale gases have much lower pressures. Therefore, such formations would damage much easier when using conventional oil and gas drilling technology.

The present invention reduces the amount of contact between the formation and drill cuttings which normally results when using air drilling, mud drilling, fluid drilling and underbalanced drilling by using a concentric coiled tubing string drilling system. Such a reduction in contact will result in a reduction in formation damage.

SUMMARY OF THE INVENTION

The present invention allows for the drilling of hydrocarbon formations in a less damaging and safe manner. The invention works particularly well in under-pressured hydrocarbon formations where existing underbalanced technologies can damage the formation.

The present invention uses a two-string or concentric coiled tubing drill string allowing for drilling fluid and drill cuttings to be removed through the concentric coiled tubing drill string, instead of through the annulus between the drill string and the formation.

The use of coiled tubing instead of drill pipe provides the additional advantage of continuous circulation while drilling, thereby minimizing pressure fluctuations and reducing formation damage. When jointed rotary pipe is used, circulation must be stopped while making or breaking connections to trip in or out of the hole. Further, when using jointed pipe, at each connection, any gas phase in the drilling fluid tends to separate out of the fluid resulting in pressure fluctuations against the formation.

The present invention allows for a well bore to be drilled, either from surface or from an existing casing set in the ground at some depth, with reverse circulation so as to avoid or minimize contact between drill cuttings and the formation that has been drilled. The well bore may be drilled overbalanced or underbalanced with drilling medium comprising drilling mud, drilling fluid, gaseous drilling fluid such as compressed air or a combination of drilling fluid and gas. In any of these cases, the drilling medium is reverse circulated up the concentric coiled tubing drill string with the drill cuttings such that drill cuttings are not in contact with the formation. Where required for safety purposes, an apparatus is included in or on the concentric coiled tubing string which is capable of closing off flow from the inner string, the annulus between the outer string and the inner string, or both to safeguard against uncontrolled flow from the formation to surface.

The present invention has a number of advantages over conventional drilling technologies in addition to reducing drilling damage to the formation. The invention reduces the accumulation of drill cuttings at the bottom of the well bore; it allows for gas zones to be easily identified; and multi-zones of gas in shallow gas well bores can easily be identified without significant damage during drilling.

In accordance with one aspect of the invention, a method for drilling a well bore in a hydrocarbon formation is provided herein, comprising the steps of;

- providing a concentric coiled tubing drill string having an inner coiled tubing string, said inner coiled tubing string having an inside wall and an outside wall and situated within an outer coiled tubing string having an inside wall and an outside wall, said outside wall of said inner coiled tubing string and said inside wall of said outer coiled tubing string defining an annulus between the coiled tubing strings;
- connecting a drilling means at the lower end of the concentric coiled tubing drill string; and
- delivering drilling medium through one of said annulus or inner coiled tubing drill string for operating the drilling means to form a borehole and removing exhaust drilling medium by extracting exhaust drilling medium through said other of said annulus or inner coiled tubing string.

The coiled tubing strings may be constructed of steel, fiberglass, composite material, or other such material capable of withstanding the forces and pressures of the operation. The coiled tubing strings may be of consistent wall thickness or tapered.

In one embodiment of the drilling method, the drilling medium is delivered through the annulus and the exhaust drilling medium is removed through the inner coiled tubing string.

In another embodiment, the flow paths may be reversed, such that the drilling medium is pumped down the inner coiled tubing string to drive the drilling means and exhaust drilling medium, comprising any combination of drilling medium, drill cuttings and hydrocarbons, is extracted through the annulus between the inner coiled tubing string and the outer coiled tubing string.

The drilling medium can comprise a liquid drilling fluid such as, but not limited to, water, diesel, or drilling mud, or a combination of liquid drilling fluid and gas such as, but not limited to, air, nitrogen, carbon dioxide, and methane, or gas alone. The drilling medium is pumped down the annulus to the drilling means to drive the drilling means. Examples of suitable drilling means are a reverse-circulating mud motor with a rotary drill bit, or a mud motor with a reverse circulating drilling bit. When the drilling medium is a gas, a reverse circulating air hammer or a positive displacement air motor with a reverse circulating drill bit can be used.

In a preferred embodiment, the drilling means further comprises a diverter means such as, but not limited to, a venturi or a fluid pumping means, which diverts or draws the exhaust drilling medium, the drill cuttings, and any hydrocarbons back into the inner coiled tubing string where they are flowed to surface. This diverter means may be an integral part of the drilling means or a separate apparatus.

The method for drilling a well bore can further comprise the step of providing a downhole flow control means attached to the concentric coiled tubing drill string near the drilling means for preventing any flow of hydrocarbons to the surface from the inner coiled tubing string or the annulus or both when the need arises. The downhole flow control means is capable of shutting off flow from the well bore through the inside of the inner coiled tubing string, through the annulus between the inner coiled tubing string and the outer coiled tubing string, or through both.

The downhole flow control means can operate in a number of different ways, including, but not limited to:

1. providing an electrical cable which runs inside the inner coiled tubing string from surface to the end of the concentric string, such that the downhole flow control means is activated by a surface control means which transmits an electrical charge or signal to an actuator at or near the downhole flow control means;
2. providing a plurality of small diameter capillary tubes which run inside the inner coiled tubing string from surface to the end of the concentric string, such that the downhole flow control means is activated by a surface control means which transmits hydraulic or pneumatic pressure to an actuator at or near the downhole flow control means;
3. providing a plurality of fiber optic cables which run inside the inner coiled tubing string from surface to the end of the concentric string, such that the downhole flow control means is activated by a surface control means which transmits light pulses or signals to an actuator at or near the downhole flow control means; and
4. providing a radio frequency transmitting device located at surface that actuates a radio frequency receiving actuator located at or near the downhole flow control means.

In another preferred embodiment, the method for drilling a well bore can further comprise the step of providing a surface flow control means for preventing any flow of hydrocarbons from the space between the outside wall of the outer coiled tubing string and the walls of the formation or well bore. The surface flow control means may be in the form of annular bag blowout preventors, which seal around the outer coiled tubing string when operated under hydraulic pressure, or annular ram or closing devices, which seal around the outer coiled tubing string when operated under hydraulic pressure, or a shearing and sealing ram which cuts through both strings of coiled tubing and closes the well bore permanently. The specific design and configuration of these surface flow control means will be dependent on the pressure and content of the well bore fluid, as determined by local law and regulation.

In another preferred embodiment, the method for drilling a well bore further comprises the step of reducing the surface pressure against which the inner coiled tubing string is required to flow by means of a surface pressure reducing means attached to the inner coiled tubing string. The surface pressure reducing means provides some assistance to the flow and may include, but not be limited to, a suction compressor capable of handling drilling mud, drilling fluids, drill cuttings and hydrocarbons installed on the inner coiled tubing string at surface.

In another preferred embodiment, the method for drilling a well bore further comprises the step of directing the extracted exhaust drilling medium to a discharge location sufficiently remote from the well bore to provide for well site safety. This can be accomplished by means of a series of pipes, valves and rotating pressure joint combinations so as to provide for safety from combustion of any produced hydrocarbons. Any hydrocarbons present in the exhaust drilling medium can flow through a system of piping or conduit directly to atmosphere, or through a system of piping and/or valves to a pressure vessel, which directs flow from the well to a flare stack or riser or flare pit.

The present invention further provides an apparatus for drilling a well bore in hydrocarbon formations, comprising:

a concentric coiled tubing drill string having an inner coiled tubing string having an inside wall and an outside wall and an outer coiled tubing string having an inside wall and an outside wall, said outside wall of said inner coiled tubing string and said inside wall of said outer coiled tubing string defining an annulus between the coiled tubing strings;

a drilling means at the lower end of said concentric coiled tubing drill string; and a drilling medium delivery means for delivering drilling medium through one of said annulus or inner coiled tubing string for operating the drilling means to form a borehole and for removing exhaust drilling medium through said other of said annulus or inner coiled tubing string.

The drilling medium can be air, drilling mud, drilling fluids, gases or various combinations of each.

In a preferred embodiment, the apparatus further comprises a downhole flow control means positioned near the drilling means for preventing flow of hydrocarbons from the inner coiled tubing string or the annulus or both to the surface of the well bore.

In a further preferred embodiment, the apparatus further comprises a surface flow control means for preventing any flow of hydrocarbons from the space between the outside wall of the outer coiled tubing string and the walls of the well bore.

In another preferred embodiment, the apparatus further comprises means for connecting the outer coiled tubing string and the inner coiled tubing string to the drilling means. The connecting means centers the inner coiled tubing string within the outer coiled tubing string, while still providing for isolation of flow paths between the two coiled tubing strings. In normal operation the connecting means would not allow for any movement of one coiled tubing string relative to the other, however may provide for axial movement or rotational movement of the inner coiled tubing string relative to the outer coiled tubing string in certain applications.

In another preferred embodiment, the apparatus further comprises a disconnecting means located between the connecting means and the drilling means, to provide for a way of disconnecting the drilling means from the concentric coiled tubing drill string. The means of operation can include, but not be limited to, electric, hydraulic, or shearing tensile actions.

In another preferred embodiment, the apparatus further comprises a rotation means attached to the drilling means when said drilling means comprising a reciprocating air hammer and a drilling bit. This is seen as a way of improving the cutting action of the drilling bit.

In another preferred embodiment, the apparatus further comprises means for storing the concentric coiled tubing drill string such as a work reel. The storage means may be integral to the coiled tubing drilling apparatus or remote, said storage means being fitted with separate rotating joints dedicated to each of the inner coiled tubing string and annulus. These dedicated rotating joints allow for segregation of flow between the inner coiled tubing string and the annulus, while allowing rotation of the coiled tubing work reel and movement of the concentric coiled tubing string in and out of the well bore.

DESCRIPTION OF THE PREFERRED EMBODIMENTS

Figure 1:
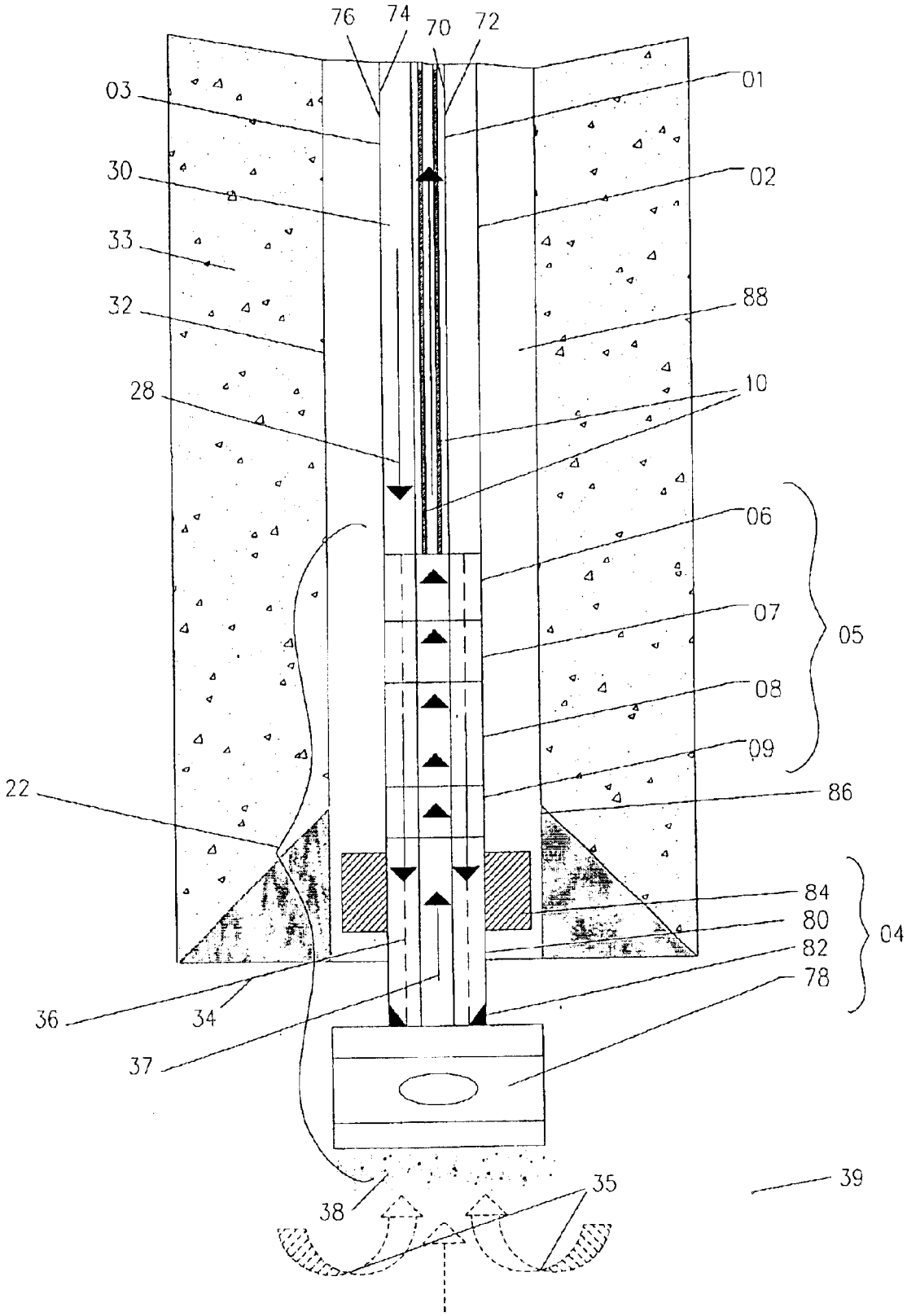
FIG. 1 is a vertical cross-section of a section of concentric coiled tubing drill string.

FIG. 1 is a vertical cross-section of concentric coiled tubing drill string 03 useful for drilling a well bore in hydrocarbon formations according to the present invention. Concentric coiled tubing drill string 03 comprises an inner coiled tubing string 01 having an inside wall 70 and an outside wall 72 and an outer coiled tubing string 02 having an inside wall 74 and an outside wall 76. The inner coiled tubing string 01 is inserted inside the outer coiled tubing string 02. The outer coiled tubing string 02 typically has an outer diameter of 73.0 mm or 88.9 mm, and the inner coiled tubing string 01 typically has an outer diameter of 38.1 mm, 44.5 mm, or 50.8 mm. Other diameters of either string may be run as deemed necessary for the operation. Concentric coiled tubing drill string annulus 30 is formed between the outside wall 72 of the inner coiled tubing string 01 and the inside wall 74 of the outer coiled tubing string 02.

Concentric coiled tubing drill string 03 is connected to bottom hole assembly 22, said bottom hole assembly 22 comprising a reverse-circulating drilling assembly 04 and a reverse-circulating motor head assembly 05. Reverse circulating motor head assembly 05 comprises concentric coiled tubing connector 06 and, in preferred embodiments, further comprises a downhole blowout preventor or flow control means 07, disconnecting means 08, and rotating sub 09. Reverse-circulating drilling assembly 04 comprises impact or drilling bit 78 and impact hammer 80.

Rotating sub 09 rotates the reverse-circulation drilling assembly 04 to ensure that drilling bit 78 doesn't strike at only one spot in the well bore. Disconnecting means 08 provides a means for disconnecting concentric coiled tubing drill string 03 from the reverse-circulation drilling assembly 04 should it get stuck in the well bore. Downhole flow control means 07 enables flow from the well bore to be shut off through either or both of the inner coiled tubing string 01 and the concentric coiled tubing drill string annulus 30 between the inner coiled tubing string 01 and the outer coiled tubing string 02. Concentric coiled tubing connector 06 connects outer coiled tubing string 02 and inner coiled tubing string 01 to the bottom hole assembly 22. It should be noted, however, that outer coiled tubing string 02 and inner coiled tubing string 01 could be directly connected to reverse-circulation drilling assembly 04.

Flow control means 07 operates by means of two small diameter capillary tubes 10 that are run inside inner coiled tubing string 01 and connect to closing device 07. Hydraulic or pneumatic pressure is transmitted through capillary tubes 10 from surface. Capillary tubes 10 are typically stainless steel of 6.4 mm diameter, but may be of varying material and of smaller or larger diameter as required.

Drilling medium 28 is pumped through concentric coiled tubing drill string annulus 30, through the motor head assembly 05, and into a flow path 36 in the reverse-circulating drilling assembly 04, while maintaining isolation from the inside of the inner coiled tubing string 01. The drilling fluid 28 powers the reverse-circulating drilling assembly 04, which drills a hole in the casing 32, cement 33, and/or hydrocarbon formation 34 resulting in a plurality of drill cuttings 38.

Exhaust drilling medium 35 from the reverse-circulating drilling assembly 04 is, in whole or in part, drawn back up inside the reverse-circulating drilling assembly 04 through a flow path 37 which is isolated from the drilling fluid 28 and the flow path 36. Along with exhaust drilling medium 35, drill cuttings 38 and formation fluids 39 are also, in whole or in part, drawn back up inside the reverse-circulating drilling assembly 04 and into flow path 37. Venturi 82 aids in accelerating exhaust drilling medium 35 to ensure that drill cuttings are removed from downhole. Shroud 84 is located between impact hammer 80 and inner wall 88 of well bore 32 in relatively air tight and frictional engagement with the inner wall 86. Shroud 84 reduces exhaust drilling medium 36 and drill cuttings 38 from escaping up the well bore annulus 88 between the outside wall 76 of outer coiled tubing string 02 and the inside wall 86 of well bore 32 so that the exhaust drilling medium, drill cuttings 38, and formation fluids 39 preferentially flow up the inner coiled tubing string 01. Exhaust drilling medium 35, drill cuttings 38, and formation fluids 39 from flow path 37 are pushed to surface under formation pressure.

In another embodiment of the present invention, drilling medium can be pumped down inner coiled tubing string 01 and exhaust drilling medium carried to the surface of the well bore through concentric coiled tubing drill string annulus 30. Reverse circulation of the present invention can use as a drilling medium air, drilling muds or drilling fluids or a combination of drilling fluid and gases such as nitrogen and air.

Figure 2:
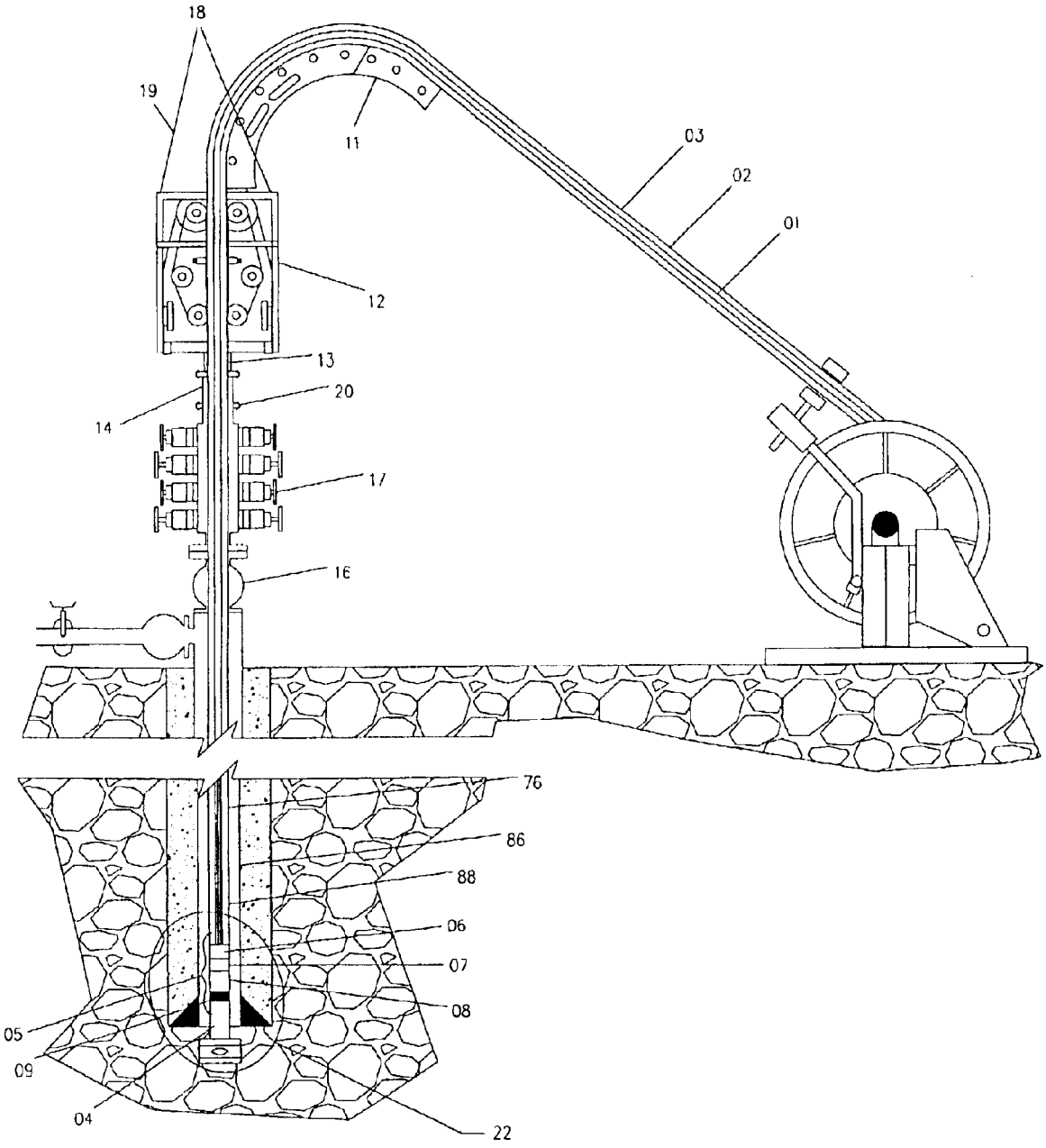
FIG. 2 is a general view showing a partial cross-section of the apparatus and method of the present invention as it is located in a drilling operation.

FIG. 2 shows a preferred embodiment of the present method and apparatus for safely drilling a natural gas well or any well containing hydrocarbons using concentric coiled tubing drilling. Concentric coiled tubing drill string 03 is run over a gooseneck or arch device 11 and stabbed into and through an injector device 12. Arch device 11 serves to bend concentric coiled tubing string 03 into injector device 12, which serves to push the concentric coiled tubing drill string into the well bore, or pull the concentric coiled tubing string 03 from the well bore as necessary to conduct the operation. Concentric coiled tubing drill string 03 is pushed or pulled through a stuffing box assembly 13 and into a lubricator assembly 14. Stuffing box assembly 13 serves to contain well bore pressure and fluids, and lubricator assembly 14 allows for a length of coiled tubing or bottomhole assembly 22 to be lifted above the well bore and allowing the well bore to be closed off from pressure.

As was also shown in FIG. 1, bottom hole assembly 22 is connected to the concentric coiled tubing drill string 03. Typical steps would be for the motor head assembly 05 to be connected to the concentric coiled tubing drill string 03 and pulled up into the lubricator assembly 14. Reverse-circulating drilling assembly 04 is connected to motor head assembly 05 and also pulled into lubricator assembly 14. Lubricator assembly 14 is manipulated in an upright position directly above the wellhead 16 and surface blowout preventor 17 by means of crane 18 with a cable and hook assembly 19. Lubricator assembly 14 is attached to surface blowout preventor 17 by a quick-connect union 20. Lubricator assembly 14, stuffing box assembly 13, and surface blowout preventor 17 are pressure tested to ensure they are all capable of containing expected well bore pressures without leaks. Downhole flow control means 07 is also tested to ensure it is capable of closing from surface actuated controls (not shown) and containing well bore pressure without leaks.

Surface blowout preventor 17 is used to prevent a sudden or uncontrolled flow of hydrocarbons from escaping from the well bore annulus 88 between the inner well bore wall 86 and the outside wall 76 of the outer coiled tubing string 02 during the drilling operation. An example of such a blowout preventor is Texas Oil Tools Model # EG72-T004. Surface blowout preventor 17 is not equipped to control hydrocarbons flowing up the inside of concentric coiled tubing drill string, however.

Figure 3:
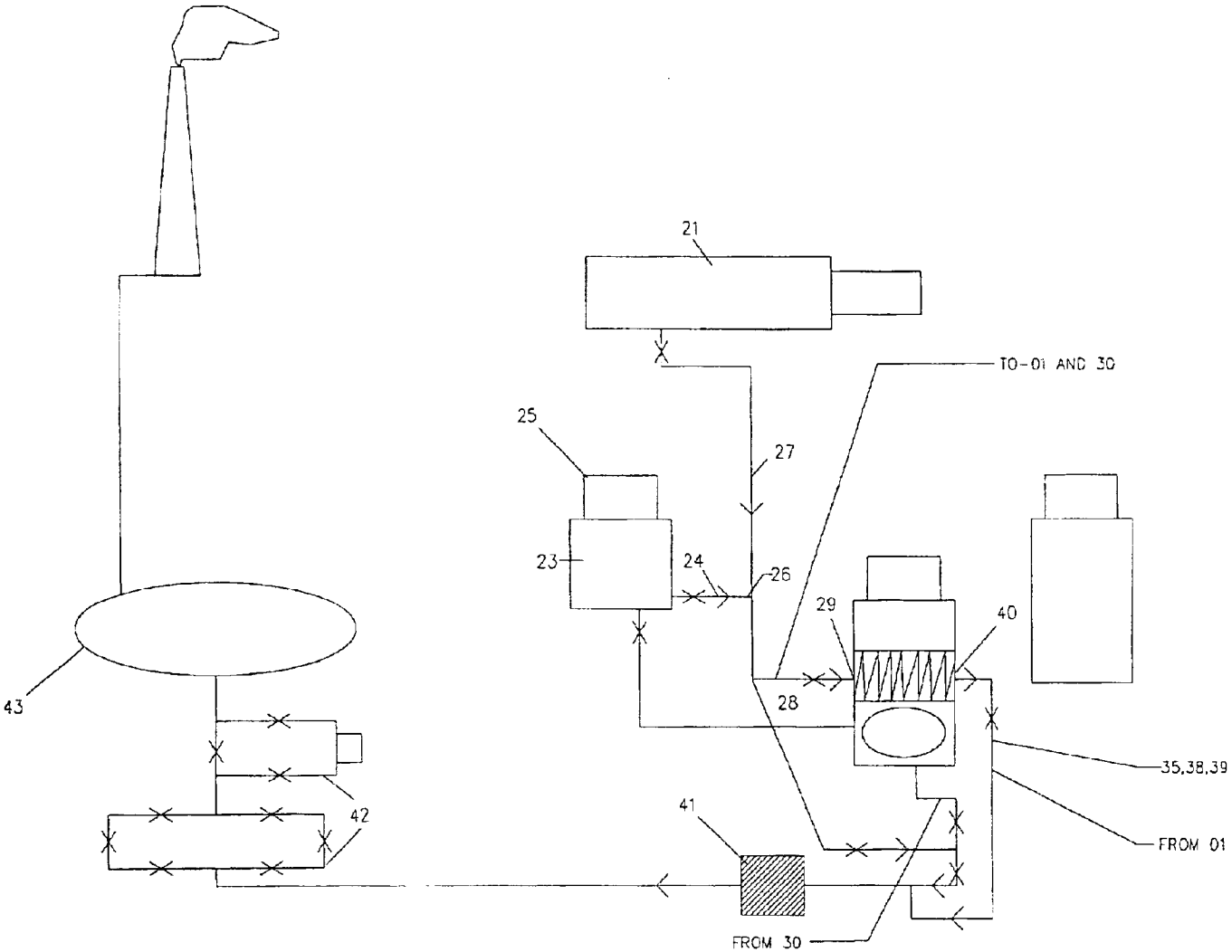
FIG. 3 is a schematic drawing of the operations used for the removal of exhaust drilling medium out of the well bore.

FIG. 3 is a schematic drawing of the operations used for the removal of exhaust drilling medium out of the well bore. Suction compressor 41 or similar device may be placed downstream of the outlet rotating joint 40 to maintain sufficient fluid velocity inside the inner coiled tubing string 01 to keep all solids moving upwards and flowed through an outlet rotating joint 40. This is especially important when there is insufficient formation pressure to move exhaust medium 35, drill cuttings 38, and formation fluids 39 up the inner space of the inner coiled tubing string 01. Outlet rotating joint 40 allows exhaust medium 35, drill cuttings 38, and formation fluids 39 to be discharged from the inner space of inner coiled tubing string 01 while maintaining pressure control from the inner space, without leaks to atmosphere or to concentric coiled tubing drill string annulus 30 while moving the concentric coiled tubing drill string 03 into or out of the well bore.

Upon completion of pressure testing, wellhead 16 is opened and concentric coiled tubing drill string 03 and bottom hole assembly 22 are pushed into the well bore by the injector device 12. A hydraulic pump 23 may pump drilling mud or drilling fluid 24 from a storage tank 25 Into a flow line T-junction 26. In the alternative, or in combination, air compressor or nitrogen source 21 may also pump air or nitrogen 27 into a flow line to T-junction 26. Therefore, drilling medium 28 can consist of drilling mud or drilling fluid 24, gas 27, or a commingled stream of drilling fluid 24 and gas 27 as required for the operation.

Drilling medium 28 is pumped into the inlet rotating joint 29 which directs drilling medium 28 into concentric coiled tubing drill string annulus 30 between inner coiled tubing string 01 and outer coiled tubing string 02. Inlet rotating joint 29 allows drilling medium 28 to be pumped into concentric coiled tubing drill string annulus 30 while maintaining pressure control from concentric coiled tubing drill string annulus 30, without leaks to atmosphere or to inner coiled tubing string 01, while moving concentric coiled tubing drill string 03 into or out of the well bore.

Exhaust drilling medium 35, drill cuttings 38, and formation fluids 39 flow from the outlet rotating joint 40 through a plurality of piping and valves 42 to a surface separation system 43. Surface separation system 43 may comprise a length of straight piping terminating at an open tank or earthen pit, or may comprise a pressure vessel capable of separating and measuring liquid, gas, and solids. Exhaust medium 35, drill cuttings 38, and formation fluids 39, including hydrocarbons, that are not drawn into the reverse-circulation drilling assembly may flow up the well bore annulus 88 between the outside wall 76 of outer coiled tubing string 02 and the inside wall 86 of well bore 32. Materials flowing up the well bore annulus 88 will flow through wellhead 16 and surface blowout preventor 17 and be directed from the blowout preventor 17 to surface separation system 43.

Figure 4A:
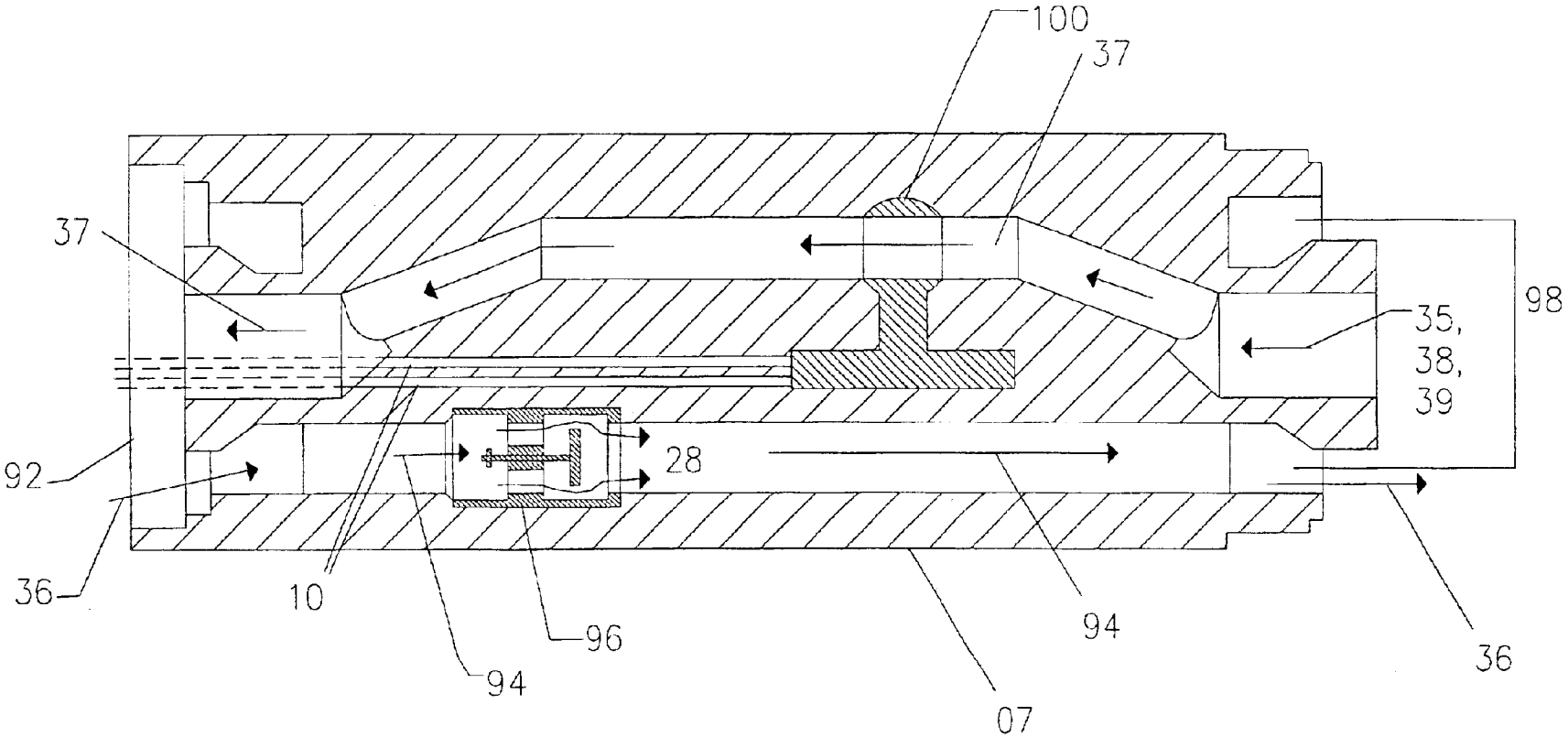
FIG. 4*a* shows a vertical cross-section of a downhole flow control means in the open position.
Figure 4B:
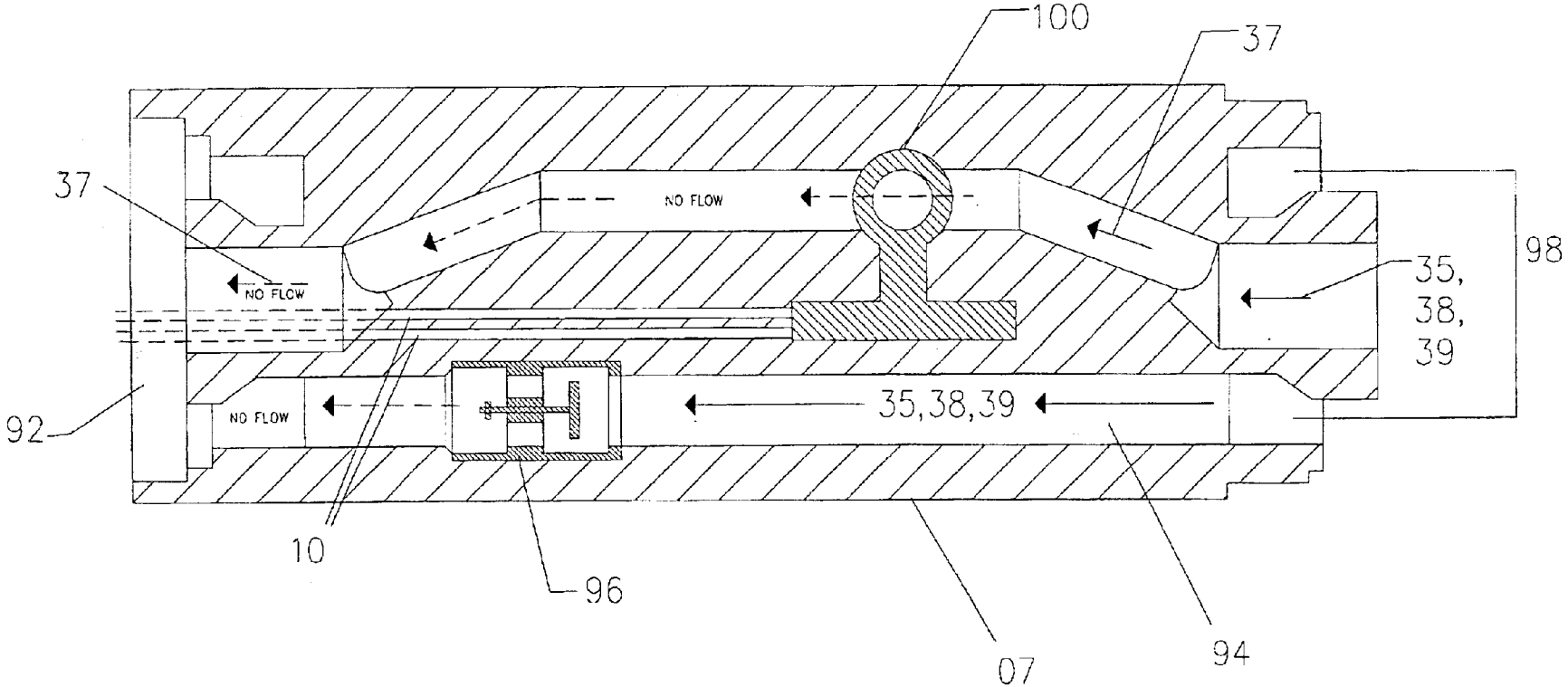
FIG. 4*b* shows a vertical cross-section of a downhole flow control means in the closed position.

FIG. 4*a* is a vertical cross-section of downhole flow control means 07 in open position and FIG. 4*b* is a vertical cross-section of downhole flow control means 07 in closed position. Downhole flow control means 07 may be required within motor head assembly 05 to enable flow from the well bore to be shut off through either or both of the inner coiled tubing string 01 or the concentric coiled tubing drill string annulus 30. For effective well control, the closing device should be capable of being operated from surface by a means independent of the well bore conditions, or in response to an overpressure situation from the well bore.

Referring first to FIG. 4*a*, the downhole flow control means 07 allows drilling medium 28 to flow through annular flow path 90. Drilling medium from the annular flow path 36 is directed in first diffuser sub 92 that takes the annular flow path 36 and channels it into single monobore flow path 94. Drilling medium 28 flows through single monobore flow path 94 and through a check valve means 96 which allows flow in the intended direction, but operates under a spring mechanism to stop flow from reversing direction and traveling back up the annular flow path 36 or the single monobore flow path 94. Downstream of check valve means 96 single monobore flow path 94 is directed through second diffuser sub 98 which re-directs flow from single monobore flow path 94 back to annular flow path 36. When operated in the open position, exhaust drilling medium 35, drill cuttings 38 and formation fluid 39, including hydrocarbons, flow up through inner coiled tubing flow path 37. Inner coiled tubing flow path 37 passes through hydraulically operated ball valve 100 that allows full, unobstructed flow when operated in the open position.

Referring now to FIG. 4*b*, downhole flow control means 07 is shown in the closed position. To provide well control from inner coiled tubing flow path 37, hydraulic pressure is applied at pump 47 to one of capillary tubes 10. This causes ball valve 100 to close thereby closing off inner coiled tubing flow path 37 and preventing uncontrolled flow of formation fluids or gas through the inner coiled tubing string 01. In the event of an overpressure situation in single monobore flow path 94, check valve 96 closes with the reversed flow and prevents reverse flow through single monobore flow path 94. In this embodiment, well bore flow is thus prohibited from flowing up annular flow path 36 or single monobore flow path 94 in the event formation pressure exceeds pumping pressure, thereby providing well control in the annular flow path 36.

An optional feature of downhole flow control means 07 would allow communication between single monobore flow path 94 and inner coiled tubing flow path 37 when the downhole flow control means is operated in the closed position. This would allow continued circulation down annular flow path 36 and back up inner coiled tubing flow path 37 without being open to the well bore.

Figure 5:
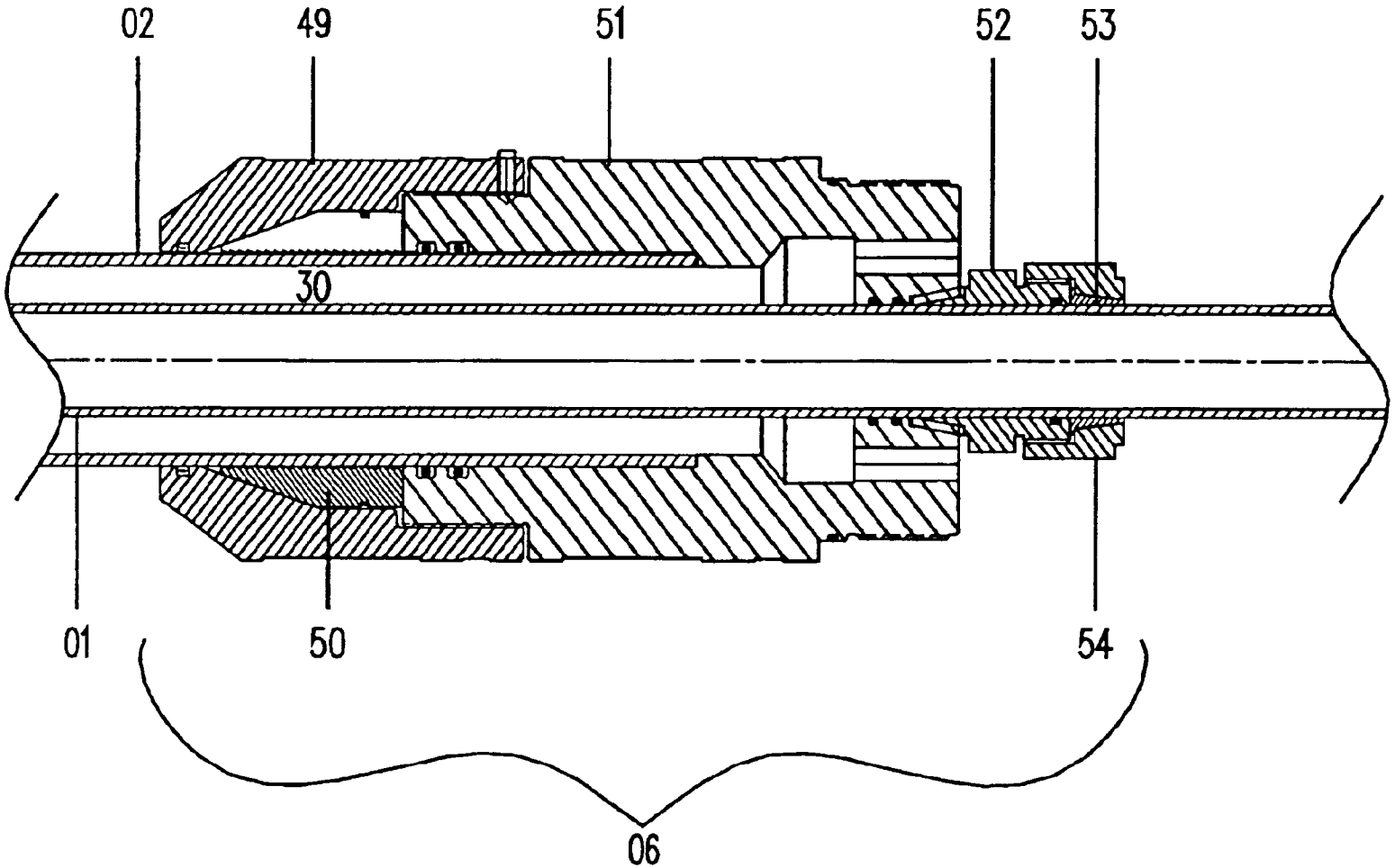
FIG. 5 shows a vertical cross-section of a concentric coiled tubing connector.

FIG. 5 is a vertical cross-section of concentric coiled tubing connector 06. Both outer coiled tubing string 02 and the inner coiled tubing string 01 are connected to bottom hole assembly by means of concentric coiled tubing connector 06. First connector cap 49 is placed over outer coiled tubing string 02. First external slip rings 50 are placed inside first connector cap 49, and are compressed onto outer coiled tubing string 02 by first connector sub 51, which is threaded into first connector cap 49. Inner coiled tubing string 01 is extended through the bottom of first connector sub 51, and second connector cap 52 is placed over inner coiled tubing string 01 and threaded into first connector sub 51. Second external slip rings 53 are placed inside second connector cap 52, and are compressed onto inner coiled tubing string 01 by second connector sub 54, which is threaded into second connector cap 52. First connector sub 51 is ported to allow flow through the sub body from concentric coiled tubing drill string annulus 30.

Figure 6:
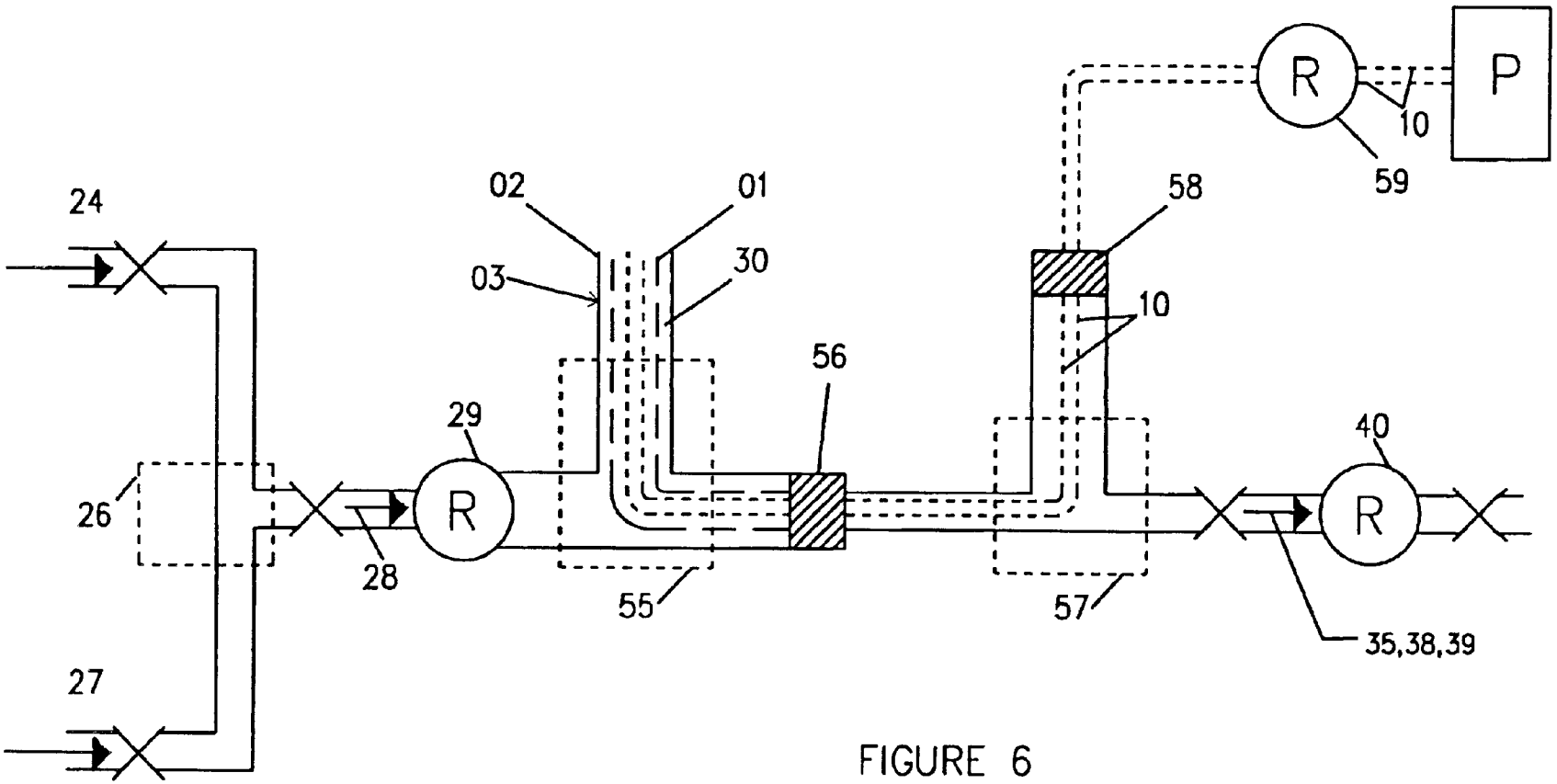
FIG. 6 is a schematic drawing of a concentric coiled tubing bulkhead assembly.

FIG. 6 is a schematic diagram of a coiled tubing bulkhead assembly. Drilling medium 28 is pumped into rotary joint 29 to first coiled tubing bulkhead 55, which is connected to the concentric coiled tubing drill string 03 by way of outer coiled tubing string 02 and ultimately feeds concentric coiled tubing drill string annulus 30. First coiled tubing bulkhead 55 is also connected to inner coiled tubing string 01 such that flow from the inner coiled tubing string 01 is isolated from concentric coiled tubing drill string annulus 30. Inner coiled tubing string 01 is run through a first packoff device 56 which removes it from contact with concentric coiled tubing drill string annulus 30 and connects it to second coiled tubing bulkhead 57. Flow from inner coiled tubing string 01 flows through second coiled tubing bulkhead 57, through a series of valves, and ultimately to outlet rotary joint 40, which permits flow from inner coiled tubing string 01 under pressure while the concentric coiled tubing drill string 03 is moved into or out of the well. Flow from inner coiled tubing string 01, which comprises exhaust drilling medium 35, drill cuttings 38 and formation fluid 39, including hydrocarbons, is therefore allowed through outlet rotary joint 40 and allowed to discharge to the surface separation system.

An additional feature of second coiled tubing bulkhead 57 is that it provides for the insertion of one or more smaller diameter tubes or devices, with pressure control, into the inner coiled tubing string 01 through second packoff 58. In the preferred embodiment, second packoff 58 provides for two capillary tubes 10 to be run inside the inner coiled tubing string 01 for the operation and control of downhole flow control means 07. The capillary tubes 10 are connected to a third rotating joint 59, allowing pressure control of the capillary tubes 10 while rotating the work reel.

While various embodiments in accordance with the present invention have been shown and described, it is understood that the same is not limited thereto, but is susceptible of numerous changes and modifications as known to those skilled in the art, and therefore the present invention is not to be limited to the details shown and described herein, but intend to cover all such changes and modifications as are encompassed by the scope of the appended claims.

I claim:

1. A method for drilling a well bore in a hydrocarbon formation, comprising:

providing a concentric coiled tubing drill string having an inner coiled tubing string, said inner coiled tubing string having an inside wall and an outside wall and situated within an outer coiled tubing string having an inside wall and an outside wall, said outside wall of said inner coiled tubing string and said inside wall of said outer coiled tubing string defining an annulus between the coiled tubing strings;

connecting a drilling means at the lower end of the concentric coiled tubing drill string; and delivering drilling medium through one of said annulus or inner coiled tubing string for both operating the drilling means to form a borehole and for entraining and removing drill cuttings through said other of said annulus or inner coiled tubing string.

2. The method of claim 1 wherein the drilling medium is delivered through the annulus and entrained drill cuttings are removed through the inner coiled tubing string.

3. The method of claim 1 wherein the drilling medium is delivered through the inner coiled tubing string and the entrained drill cuttings are removed through the annulus.

4. The method of claim 1 wherein said drilling means is a reverse circulating drilling means.

5. The method of claim 1 wherein said drilling medium is selected from the group consisting of drilling mud, drilling fluid and a mixture of drilling fluid and gas.

6. The method of claim 5 wherein said drilling means comprises a positive displacement motor and a reverse circulating drill bit.

7. The method of claim 5 wherein said drilling means comprises a mud motor and a rotary drill bit.

8. The method of claim 7 wherein said mud motor is a reverse circulating mud motor.

9. The method of claim 1 wherein said drilling medium comprises a gas selected from the group consisting of air, nitrogen, carbon dioxide, methane and any combination of air, nitrogen, carbon dioxide or methane.

10. The method of claim 9 wherein said drilling means comprises a reciprocating air hammer and a dull bit.

11. The method of claim 10 wherein said drilling means comprises a positive displacement motor and a reverse circulating drill bit.

12. The method of claim 1, said drilling means further comprising a diverter means, said method further comprising accelerating said entrained drill cuttings by passing said entrained drill cuttings through said diverter means so as to facilitate removal of said entrained drill cuttings through the annulus or the inner coiled tubing string.

13. The method of claim 12 wherein said diverter means comprises a venturi or a fluid pumping means.

14. The method of claim 1 further comprising providing a downhole flow control means positioned at or near the drilling means for preventing flow of hydrocarbons from the inner coiled tubing string or the annulus or both to the surface of the well bore.

15. The method of claim 14 further comprising controlling said downhole flow control means at the surface of the well bore by a surface control means.

16. The method of claim 15 wherein said surface control means transmits a signal selected from the group consisting of an electrical signal, a hydraulic signal, a pneumatic signal, a light signal and a radio signal.

17. The method of claim 1 further comprising providing a surface flow control means positioned at or near the surface of the well bore for preventing flow of hydrocarbons from a space between the outside wall of the outer coiled tubing string and a wall of the borehole.

18. The method of claim 1, said concentric coiled tubing drill suing further comprising a discharging means positioned near the top of said concentric coiled tubing drill string, said method further comprising removing said entrained drill cuttings through said discharging means away from said well bore.

19. The method of claim 18 wherein said discharging means further comprises a flare means for flaring hydrocarbons produced from the well bore.

20. The method of claim 1 further comprising providing a shroud means positioned between the outside wall of the outer coiled tubing string and a wall of the well bore for reducing the flow of entrained drill cuttings through a space between the outside wall of the outer coiled tubing string and a wall of the borehole.

21. The method of claim 1 further comprising providing a suction type compressor for extracting said entrained drill cuttings through said annulus or inner coiled tubing string.

22. The method of claim 1 further comprising reducing the surface pressure in the inner coiled tubing string by means of a surface pressure reducing means attached to the inner coiled tubing string.

23. An apparatus for drilling a well bore in a hydrocarbon formation, comprising:

a concentric coiled tubing drill string consisting essentially of an inner coiled tubing string, said inner coiled tubing string having an inside wall and an outside wall and situated within an outer coiled tubing string having an inside wall and an outside wall, said outside wall of said inner coiled tubing string and said inside wall of said outer coiled tubing string defining an annulus between the coiled tubing strings;

a drilling means attached to the lower end of the concentric coiled tubing drill string; and a drilling medium delivery means for delivering chilling medium through one of said annulus or inner coiled tubing string for both operating the drilling means to form a borehole and for entraining and removing drill cuttings through said other of said annulus or inner coiled tubing string.

24. The apparatus of claim 23 wherein said drilling means is a reverse circulating drilling means.

25. The apparatus of claim 23 wherein said drilling means comprises a positive displacement motor and a reverse circulating drill bit.

26. The apparatus of claim 23 wherein said drilling means comprises a mud motor and a rotary drill bit.

27. The apparatus of claim 26 wherein said mud motor is a reverse circulating mud motor.

28. The apparatus of claim 23 wherein said drilling means comprises a reciprocating air hammer and a drill bit.

29. The apparatus of claim 23 wherein said drilling means comprises a positive displacement motor and reverse circulating drill bit.

30. The apparatus of claim 23 wherein said drilling means further comprises a diverter means to facilitate removal of said entrained drill cuttings from the concentric coiled tubing drill string.

31. The apparatus of claim 30 wherein said diverter means comprises a venturi or a fluid pumping means.

32. The apparatus of claim 23 further comprising a downhole flow control means positioned at or near the drilling means for preventing flow of hydrocarbons from the inner coiled tubing string or the annulus or both to the surface of the well bore.

33. The apparatus of claim 32 further comprising a surface control means for controlling said downhole flow control means at the surface of the well bore.

34. The apparatus of claim 33 wherein said surface control means transmits a signal selected from the group consisting of an electrical signal, a hydraulic signal, a pneumatic signal, a light signal and a radio signal.

35. The apparatus of claim 23 further comprising a surface flow control means positioned at or near the surface of the well bore for reducing flow of hydrocarbons from a space between the outside wall of the outer coiled tubing string and a wall of the borehole.

36. The apparatus of claim 23 further comprising a discharging means positioned near the top of said concentric coiled tubing drill string for discharging said entrained drill cuttings through said discharging means away from said well bore.

37. The apparatus of claim 36 wherein said discharging means further comprises a flare means for flaring hydrocarbons produced from the well bore.

38. The apparatus of claim 23 further comprising a shroud means positioned between the outside wall of the outer coiled cubing string and a wall of the well bore for reducing the flow of entrained drill cuttings through a space between the outside wall of the outer coiled tubing string and a wall of the borehole.

39. The apparatus of claim 23 further comprising a suction type compressor for extracting said entrained drill cuttings through said annulus or inner coiled tubing string.

40. The apparatus of claim 23 further comprising a connecting means for connecting said outer coiled cubing string and said inner coiled tubing string to said drilling means thereby centering said inner coiled tubing string within said outer coiled tubing string.

41. The apparatus of claim 40 comprising a disconnecting means located between said connecting means and said drilling means for disconnecting said drilling means from said concentric coiled tubing drill siring.

42. The apparatus of claim 28 further comprising a rotation means attached to said reciprocating air hammer.

43. The apparatus of claim 23 further comprising means for storing said concentric coiled tubing drill string.

44. The apparatus of claim 43 wherein said storing means comprises a work reel.

45. The apparatus of claim 23 wherein said drilling medium delivery means comprises a hydraulic pump.

46. The apparatus of claim 23 wherein said drilling medium delivery means comprises an air compressor.

47. The apparatus of claim 23 wherein said drilling medium delivery means comprises a nitrogen pumper.

48. A method for drilling a well bore in a hydrocarbon formation, comprising:

providing a concentric coiled tubing drill string having an inner coiled tubing string, said inner coiled tubing string having an inside wall and an outside wall and situated within an outer coiled tubing string having an inside wall and an outside wall, said outside wall of said inner coiled tubing string and said inside wall of said outer coiled tubing string defining an annulus between the coiled tubing strings;

connecting a drilling means comprising a positive displacement motor and reverse circulating drill bit at the lower end of the concentric coiled tubing drill string; and delivering drilling medium selected from the group consisting of drilling mud, drilling fluid and a mixture of drilling fluid and gas through one of said annulus or inner coiled tubing string for operating the drilling means to form a borehole and removing exhaust drilling medium by extracting said exhaust drilling medium through said other of said annulus or inner coiled tubing string.

49. A method for drilling a well bore in a hydrocarbon formation, comprising:

providing a concentric coiled tubing drill string having an inner coiled tubing string, said inner coiled tubing string having an inside wall and an outside wall and situated within an outer coiled tubing string having an inside wall and an outside wall, said outside wall of said inner coiled tubing string and said inside wall of said outer coiled tubing string defining an annulus between the coiled tubing strings;

connecting a drilling means comprising a reverse circulating mud motor and a rotary drill bit at the lower end of the concentric coiled tubing drill string; and delivering drilling medium selected from the group consisting of drilling mud, drilling fluid and a mixture of drilling fluid and gas through one of said annulus or inner coiled tubing string for operating the drilling means to form a borehole and removing exhaust drilling medium by extracting said exhaust drilling medium through said other of said annulus or inner coiled tubing string.

50. A method for drilling a well bore in a hydrocarbon formation, comprising:

providing a concentric coiled tubing drill string having an inner coiled tubing string, said inner coiled tubing string having an inside wall and an outside wall and situated within an outer coiled tubing string having an inside wall and an outside wall, said outside wall of said inner coiled tubing string and said inside wall of said outer coiled tubing string defining an annulus between the coiled tubing strings;

connecting a drilling means comprising a positive displacement motor and a reverse circulating drill bit at the lower end of the concentric coiled tubing chill string; and delivering drilling medium through one of said annulus or inner coiled tubing string for operating the drilling means to form a borehole and removing exhaust drilling medium by extracting said exhaust drilling medium through said other of said annulus or inner coiled tubing string.

51. A method for drilling a well bore in a hydrocarbon formation, comprising:

providing a concentric coiled tubing drill string having an inner coiled tubing string, said inner coiled tubing string having an inside wall and an outside wall and situated within an outer coiled tubing string having an inside wall and an outside wall, said outside wall of said inner coiled tubing string and said inside wall of said outer coiled tubing string defining an annulus between the coiled tubing strings;

connecting a drilling means at the lower end of the concentric coiled tubing drill string;

delivering drilling medium through one of said annulus or inner coiled tubing string for operating the drilling means to form a borehole and removing exhaust drilling medium by extracting said exhaust drilling medium through said other of said annulus or inner coiled tubing string; and providing a downhole flow control means positioned at or near the drilling means for preventing flow of hydrocarbons from the inner coiled tubing string or the annulus or both to the surface of the well bore.

52. The method of claim 51 further comprising controlling said downhole flow control means at the surface of the well bore by a surface control means.

53. The method of claim 52 wherein said surface control means transmits a signal selected from the group consisting of an electrical signal, a hydraulic signal, a pneumatic signal, a light signal and a radio signal.

54. A method for drilling a well bore in a hydrocarbon formation, comprising:

providing a concentric coiled tubing drill string having an inner coiled tubing string, said inner coiled tubing string having an inside wall and an outside wall and situated within an outer coiled tubing string having an inside wall and an outside wall, said outside wall of said inner coiled tubing string and said inside wall of said outer coiled tubing string defining an annulus between the coiled tubing strings;

connecting a drilling means at the lower end of the concentric coiled tubing drill string;

delivering drilling medium through one of said annulus or inner coiled tubing string for operating the drilling means to form a borehole and removing exhaust drilling medium by extracting said exhaust drilling medium through said other of said annulus or inner coiled tubing string; and providing a surface flow control means positioned at or near the surface of the well bore for preventing flow of hydrocarbons from a space between the outside wall of the outer coiled tubing string and a wall of time borehole.

55. A method for drilling a well bore in a hydrocarbon formation; comprising the steps of:

providing a concentric coiled tubing drill string having an inner coiled tubing string, said inner coiled tubing string having an inside wall and an outside wall and situated within an outer coiled tubing string having an inside wall and an outside wall, said outside wall of said inner coiled tubing string and said inside wall of said outer coiled tubing string defining an annulus between the coiled tubing strings, said concentric coiled tubing drill string further comprising a discharging means comprising a flare means for flaring hydrocarbons produced from the well bore positioned at or near the surface of the well bore;

connecting a drilling means at the lower end of the concentric coiled tubing drill string; and delivering drilling medium through one of said annulus or inner coiled tubing string for operating the drilling means to form a borehole and removing exhaust drilling medium by extracting said exhaust drilling medium through said other of said annulus or inner coiled tubing string.

56. A method for drilling a well bore in a hydrocarbon formation, comprising the steps of:

providing a concentric coiled tubing drill string having an inner coiled tubing string, said inner coiled tubing string having an inside wail and an outside wall and situated within an outer coiled tubing string having an inside wall and an outside wall, said outside wall of said inner coiled tubing string and said inside wall of said outer celled tubing string defining an annulus between the coiled tubing strings;

connecting a drilling means at the lower end of the concentric coiled tubing drill string; and delivering drilling medium through one of said annulus or inner coiled tubing string for operating the drilling means to form a borehole and removing exhaust drilling medium by extracting said exhaust drilling medium through said other of said annulus or inner coiled tubing string; and providing a shroud means positioned between the outside wall of the outer coiled tubing string and a wall of the well bore for reducing the flow of exhaust drilling medium through a space between the outside wall of the outer coiled tubing string and a wall of the borehole.

57. An apparatus for drilling a well bore in a hydrocarbon formation, comprising;

a concentric coiled tubing drill string having an inner coiled tubing string, said inner coiled tubing string having an inside wall and an outside wall and situated within an outer coiled tubing string having an inside wall and an outside wall, said outside wall of said inner coiled tubing string and said inside wall of said outer coiled tubing string defining an annulus between the coiled tubing strings;

a drilling means attached to the lower end of the concentric coiled tubing drill string, said drilling means comprising a positive displacement motor and a reverse circulating drill bit; and a drilling medium delivery means for delivering drilling medium through one of said annulus or inner coiled tubing string for operating the drilling means to form a borehole and removing exhaust drilling medium by extracting said exhaust drilling medium through said other of said annulus or inner coiled tubing string.

58. An apparatus drilling a well bore in a hydrocarbon formation, comprising:

a concentric coiled tubing drill string having an inner coiled tubing string, said inner coiled tubing string having an inside wall and an outside wall and situated within an outer coiled tubing string having an inside wall and an outside wall, said outside wall of said inner coiled tubing string and said inside wall of said outer coiled tubing string defining an annulus between the coiled tubing strings;

a drilling means attached to the lower end of the concentric coiled tubing drill string, said drilling means comprising a reverse circulating mud motor and a rotary drill bit; and a drilling medium delivery means for delivering drilling medium through one of said annulus or inner coiled tubing string for operating the drilling means to form a borehole and removing exhaust drilling medium drill cuttings by extracting said exhaust drilling medium through said other of said annulus or inner coiled tubing string.

59. An apparatus drilling a well bore in a hydrocarbon formation, comprising:

a concentric coiled tubing drill string having an inner coiled tubing string, said inner coiled tubing string having an inside wall and an outside wall and situated within an outer coiled tubing string having an inside wall and an outside wall, said outside wall of said inner coiled tubing string and said inside wall of said outer coiled tubing string defining an annulus between the coiled tubing strings;

a drilling means attached to the lower end of the concentric coiled tubing drill string, said drilling means comprising a positive displacement motor and a reverse circulating drill bit; and a drilling medium delivery means for delivering drilling medium through one of said annulus or inner coiled tubing string for operating the drilling means to form a borehole and removing exhaust drilling medium by extracting said exhaust drilling medium through said other of said annulus or inner coiled tubing string.

60. An apparatus drilling a well bore in a hydrocarbon formation, comprising:

a concentric coiled tubing drill string having an inner coiled tubing string, said inner coiled tubing string having an inside wall and an outside wall and situated within an outer coiled tubing string having an inside wall and an outside wall, said outside wall of said inner coiled tubing string and said inside wall of said outer coiled tubing string defining an annulus between the coiled tubing strings;

a drilling means attached to the lower end of the concentric coiled tubing drill string;

a drilling medium delivery means for delivering drilling medium through one of said annulus or inner coiled tubing string for operating the drilling means to form a borehole and removing exhaust drilling medium by extracting said exhaust drilling medium through said other of said annulus or inner coiled tubing string; and a downhole flow control means positioned at or near the drilling means for preventing flow of hydrocarbons from the inner coiled tubing string or the annulus or both to the surface of the well bore.

61. An apparatus of claim 60 further comprising a surface control means for controlling said downhole flow control means at the surface of the well bore.

62. An apparatus of claim 61 wherein said surface control means transmits a signal selected from the group consisting of an electrical signal, a hydraulic signal, a pneumatic signal, a light signal and a radio signal.

63. An apparatus drilling a well bore in a hydrocarbon formation, comprising:

a concentric coiled tubing drill string having an inner coiled tubing string, said inner coiled tubing string having an inside wall and an outside wall and situated within an outer coiled tubing string having an inside wall and an outside wall, said outside wall of said inner coiled tubing string and said inside wall of said outer coiled tubing string defining an annulus between the coiled tubing strings;

a drilling means attached to the lower end of the concentric coiled tubing drill string;

a drilling medium delivery means for delivering drilling medium through one of said annulus or inner coiled tubing string for operating the drilling means to form a borehole and removing exhaust drilling medium by extracting said exhaust drilling medium through said other of said annulus or inner coiled tubing string; and a surface flow control means positioned at or near the surface of the well bore for reducing flow of hydrocarbons from a space between the outside wall of the outer coiled tubing string and a wall of the borehole.

64. An apparatus drilling a well bore in a hydrocarbon formation, comprising:

a concentric coiled tubing drill stung having an inner coiled tubing string, said inner coiled tubing string having an inside wall and an outside wall and situated within an outer coiled tubing string having an inside wall and an outside wall, said outside wall of said inner coiled tubing siring and said inside wall of said outer coiled tubing string defining an annulus between the coiled tubing strings;

a drilling means attached to the lower end of the concentric coiled tubing chill string;

a drilling medium delivery means for delivering drilling medium through one of said annulus or inner coiled tubing string for operating the drilling means to form a borehole and removing exhaust drilling medium by extracting said exhaust drilling medium through said other of said annulus or inner coiled tubing string; and a discharging means having a flare means for flaring hydrocarbons produced from the well bore positioned near the top of said concentric coiled tubing drill string for discharging said exhaust drilling medium through said discharging means away from said well bore.

65. An apparatus drilling a well bore in a hydrocarbon formation, comprising:

a concentric coiled tubing drill string having an inner coiled tubing string, said inner coiled tubing string having an inside wall and an outside wall and situated within an outer coiled tubing string having an inside wall and an outside wall, said outside wall of said inner coiled tubing string and said inside wall of said outer coiled tubing string defining an annulus between the coiled tubing strings;

a drilling medium delivery means for delivering drilling medium through one of said annulus or inner coiled tubing string for operating the drilling means to form a borehole and removing exhaust drilling medium by extracting said exhaust drilling medium through said other of said annulus or inner coiled tubing string; and a shroud means positioned between the outside wall of the outer coiled tubing string and a wall of the well bore for reducing the flow of exhaust drilling medium through a space between the outside wall of the outer coiled tubing string and a wall of the borehole.

* * * * *

UNITED STATES PATENT AND TRADEMARK OFFICE

CERTIFICATE OF CORRECTION

PATENT NO. : 6,854,534 B2
APPLICATION NO. : 10/347861
DATED : February 15, 2005
INVENTOR(S) : James I. Livingstone It is certified that error appears in the above-identified patent and that said Letters Patent is hereby corrected as shown below:

Col. 10, line 56 The last three words in claim 10 reads "a dull bit." should read --a drill bit.--.

Signed and Sealed this

Third Day of April, 2007

JON W. DUDAS
*Director of the United States Patent and Trademark Office*